US010994554B2

(12) United States Patent
Miyawaki

(10) Patent No.: US 10,994,554 B2
(45) Date of Patent: May 4, 2021

(54) THERMAL PRINTER AND PORTABLE TERMINAL

(71) Applicant: Seiko Instruments Inc., Chiba (JP)

(72) Inventor: Kouhei Miyawaki, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/594,981

(22) Filed: Oct. 7, 2019

(65) Prior Publication Data

US 2020/0122478 A1 Apr. 23, 2020

(30) Foreign Application Priority Data

Oct. 22, 2018 (JP) ..... JP2018-198666

(51) Int. Cl.

| | |
|---|---|
| ***B41J 3/36*** | (2006.01) |
| ***B41J 11/04*** | (2006.01) |
| ***B41J 29/02*** | (2006.01) |
| ***B41J 2/335*** | (2006.01) |
| ***B41J 29/13*** | (2006.01) |
| ***B41J 29/38*** | (2006.01) |

(52) U.S. Cl.

CPC ..... *B41J 2/33505* (2013.01); *B41J 3/36* (2013.01); *B41J 11/04* (2013.01); *B41J 29/02* (2013.01); *B41J 29/13* (2013.01); *B41J 29/38* (2013.01); *B41J 2202/31* (2013.01)

(58) Field of Classification Search

CPC . B41J 2/32; B41J 2/335; B41J 2/33505; B41J 3/36; B41J 11/04; B41J 29/02; B41J 2202/31

See application file for complete search history.

(56) References Cited

U.S. PATENT DOCUMENTS 6,276,848 B1 8/2001 Takizawa et al.
2006/0176360 A1* 8/2006 Montagutelli ..... B41J 2/32 347/222
2006/0291933 A1* 12/2006 Watanabe ..... B41J 11/005 400/58

(Continued)

FOREIGN PATENT DOCUMENTS

EP 1837188 A2 9/2007
EP 1837188 A3 12/2008

(Continued)

OTHER PUBLICATIONS

Extended European Search Report for European Application No. 19204639.9, dated Feb. 26, 2020, 8 pages.

*Primary Examiner* — Scott A Richmond
(74) *Attorney, Agent, or Firm* — Brinks Gilson & Lione

(57) ABSTRACT

A thermal printer includes a thermal head configured to perform printing on recording paper; a platen roller, which is arranged at a position opposed to the thermal head, and is configured to convey the recording paper by nipping the recording paper between the thermal head and the platen roller; a head support plate having conductivity, which has the thermal head to be fixed thereto; a frame, which is configured to support the head support plate, and includes a shaft support portion configured to rotatably support the platen roller about an axis; and a conductive member having conductivity, which is provided between a side surface of the shaft support portion and the head support plate.

22 Claims, 14 Drawing Sheets

(56) References Cited

U.S. PATENT DOCUMENTS

| | | | | |
|---|---|---|---|---|
| 2007/0222850 | A1* | 9/2007 | Tozaki | B41J 2/325<br>347/220 |

FOREIGN PATENT DOCUMENTS

| | | | |
|---|---|---|---|
| EP | 3246169 | A1 | 11/2017 |
| JP | 2011-037096 | A | 2/2011 |
| JP | 2011056956 | A | 3/2011 |
| WO | WO 03/080347 | A1 | 10/2003 |

* cited by examiner

THERMAL PRINTER AND PORTABLE TERMINAL

RELATED APPLICATIONS

This application claims priority to Japanese Patent Application No. 2018-198666, filed on Oct. 22, 2018, the entire content of which is incorporated herein by reference.

BACKGROUND OF THE INVENTION

1. Field of the Invention

The present invention relates to a thermal printer and a portable terminal.

2. Description of the Related Art

Hitherto, a thermal printer has been known as a printer configured to perform printing on recording paper (heat-sensitive paper). The thermal printer includes a thermal head, a platen roller, and a frame. The thermal head includes heating elements. The platen roller is configured to feed the recording paper by nipping the recording paper between the platen roller and the thermal head. The frame includes a shaft support portion configured to support the platen roller such that the platen roller is rotatable about an axis. In the thermal printer, the heating elements of the thermal head are caused to generate heat as appropriate during a course of feeding the recording paper through rotation of the platen roller, thereby being capable of printing various information on the recording paper.

The thermal printer having a configuration in which the platen roller and the thermal head are removably arranged so as to facilitate roll replacement is on the mainstream. This thermal printer has a configuration in which the platen roller side or the thermal head side is removable, and hence a gap is formed in a joint of an exterior (housing).

There are some thermal printers each having a configuration in which static electricity generated due to friction of heat-sensitive paper is released to the ground.

In some thermal printers which are mounted on portable terminals (for example, card settlement terminals), static electricity may enter from an outside in some cases. Specifically, a card reader is provided on a side surface of the thermal printer in the card settlement terminal. Therefore, static electricity generated due to friction caused when a card is slid or static electricity from a human body may enter the housing through the gap of the housing. When static electricity enters the housing, discharge to a shaft end of the platen roller occurs, and then, secondary discharge may occur in the thermal head close to the platen roller. When discharge occurs in the thermal head, there is a risk in that the electricity thereof may be routed to a control board of the terminal through a flexible substrate, resulting in an electrical malfunction.

In view of the foregoing, in the field of this kind, there has been a demand for a thermal printer and a portable terminal, which are capable of releasing static electricity discharged from outside to the ground.

SUMMARY OF THE INVENTION

According to one embodiment of the present invention, there is provided a thermal printer, including a thermal head configured to perform printing on recording paper; a platen roller, which is arranged at a position opposed to the thermal head, and is configured to convey the recording paper by nipping the recording paper between the thermal head and the platen roller; a head support plate having conductivity, which has the thermal head to be fixed thereto; a frame, which is configured to support the head support plate, and includes a shaft support portion configured to rotatably support the platen roller about an axis; and a conductive member having conductivity, which is provided between a side surface of the shaft support portion and the head support plate.

In the above-mentioned thermal printer according to the one embodiment of the present invention, wherein the conductive member is provided so as to discharge an electric current in non-contact with the head support plate.

In the above-mentioned thermal printer according to the one embodiment of the present invention, wherein the conductive member is held in contact with the head support plate.

In the above-mentioned thermal printer according to the one embodiment of the present invention, wherein the conductive member has flexibility.

In the above-mentioned thermal printer according to the one embodiment of the present invention, wherein the conductive member includes a first contact portion configured to be brought into contact with the shaft support portion; a second contact portion configured to be brought into contact with the head support plate; and a connecting portion configured to connect the first contact portion and the second contact portion to each other, and wherein at least a part of the connecting portion floats away from each of the shaft support portion and the head support plate.

In the above-mentioned thermal printer according to the one embodiment of the present invention, wherein the conductive member is removably provided to the shaft support portion.

In the above-mentioned printer according to the one embodiment of the thermal printer, wherein the shaft support portion has a groove portion having an edge portion that surrounds the platen roller about the axis, and wherein the conductive member is adjacent to at least a part of the edge portion of the groove portion.

In the above-mentioned thermal printer according to the one embodiment of the present invention, wherein the conductive member is arranged on an inner side of a shaft end of the platen roller in an axial direction.

In the above-mentioned thermal printer according to the one embodiment of the present invention, wherein the conductive member is configured to cover the shaft end of the platen roller from an outer side in the axial direction.

The above-mentioned thermal printer according to the one embodiment of the present invention, further includes a drive source, which is fixed to the frame, and is exposed to outside; a power transmission mechanism configured to transmit power of the drive source to the platen roller; and an earth member configured to connect the drive source and the head support plate to each other.

According to one embodiment of the present invention, there is provided a portable terminal, including the above-mentioned thermal printer; and a casing to which the thermal printer is mounted.

DETAILED DESCRIPTION OF THE PREFERRED EMBODIMENTS

Figure 1:
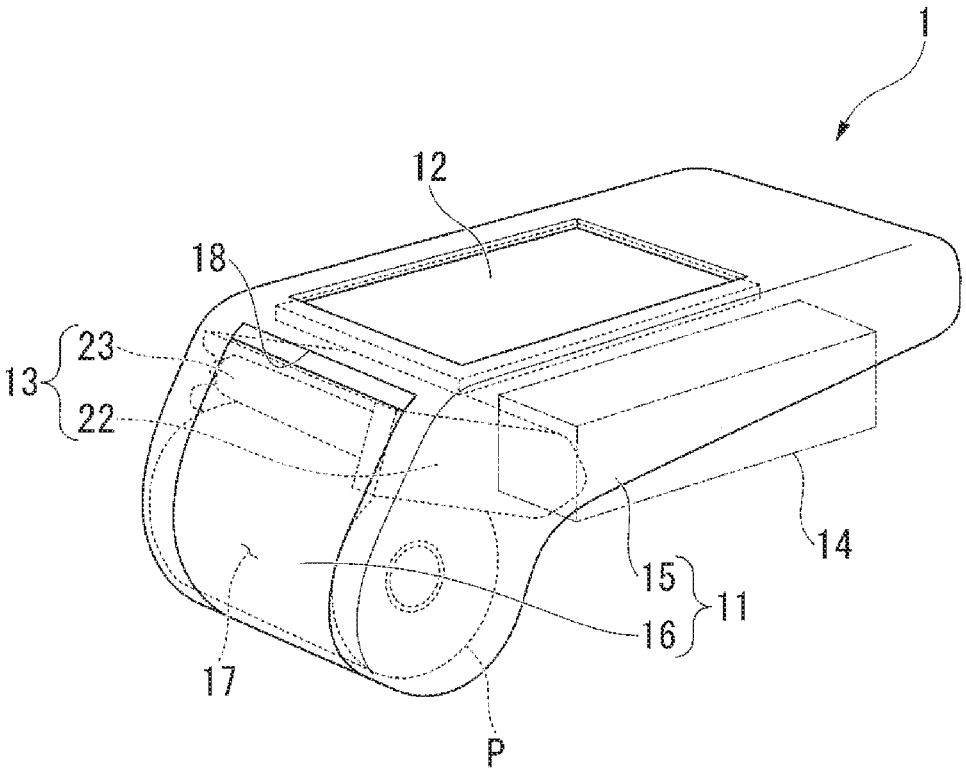
FIG. 1 is a perspective view of a portable terminal according to an embodiment of the present invention.

Now, one embodiment of the present invention is described with reference to the drawings. In the following embodiment, description is given by exemplifying a card settlement terminal (hereinafter referred to as "portable terminal") that can be carried by a user. In the drawings used for the following description, the scale reduction of each member is appropriately changed so that each member has a recognizable size.

FIG. 1 is a perspective view of a portable terminal according to the embodiment. As illustrated in FIG. 1, the portable terminal 1 includes a casing 11, an input display portion 12, a thermal printer 13, and a card reader 14.

The casing 11 includes a casing main body 15 and a printer cover 16. The casing main body 15 is formed into a box shape having a rectangular shape in plan view. In a distal end portion of the casing main body 15, there is formed a recording paper receiving portion 17 configured to receive recording paper P (heat-sensitive paper). The recording paper P is received, under a state of being wound into a roll, in the recording paper receiving portion 17.

The printer cover 16 is turnably connected to the casing main body 15 through intermediation of a hinge portion (not shown). The printer cover 16 is configured to open and close the recording paper receiving portion 17. In the casing 11, there is formed a discharge port 18, which is configured to discharge the recording paper P to outside, between an opening edge of the recording paper receiving portion 17 and a distal edge of the printer cover 16.

The input display portion 12 is arranged on a front surface of the casing 11. For example, the input display portion 12 is a touch panel. The input display portion 12 is configured to display various information on a screen and enable operation to the information displayed on the screen.

The card reader 14 is arranged on a side surface of the casing 11. The card reader 14 has a groove (hereinafter referred to as "slot") for allowing a card (not shown) to be slid. The card reader 14 can read information on the card when the card is slid in the slot.

The thermal printer 13 is mounted in the casing 11. The thermal printer 13 is arranged at a position adjacent to the discharge port 18 in the casing 11. The thermal printer 13 is configured to print information on the recording paper P, which is fed from the recording paper receiving portion 17, and to discharge the recording paper P through the discharge port 18.

Figure 2:
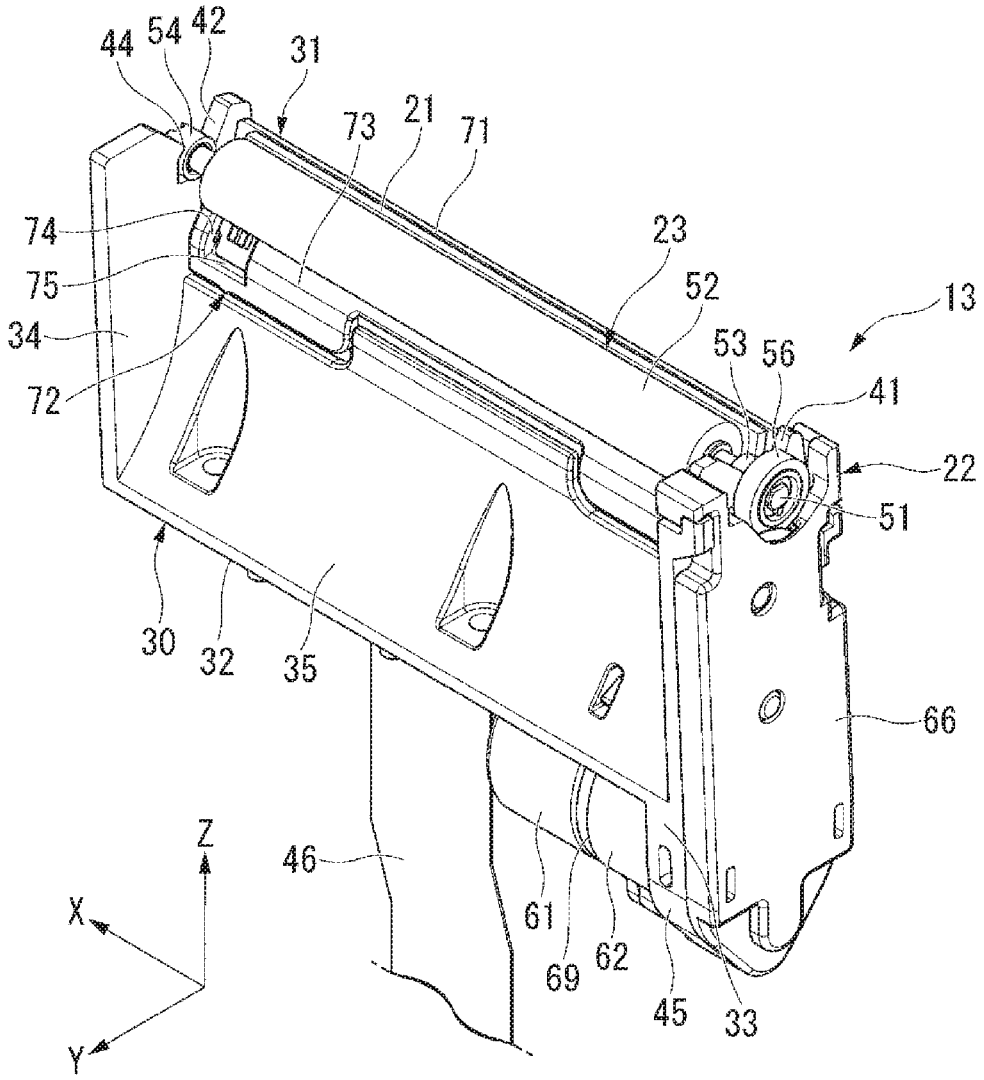
FIG. 2 is a perspective view of a thermal printer according to the embodiment.
Figure 3:
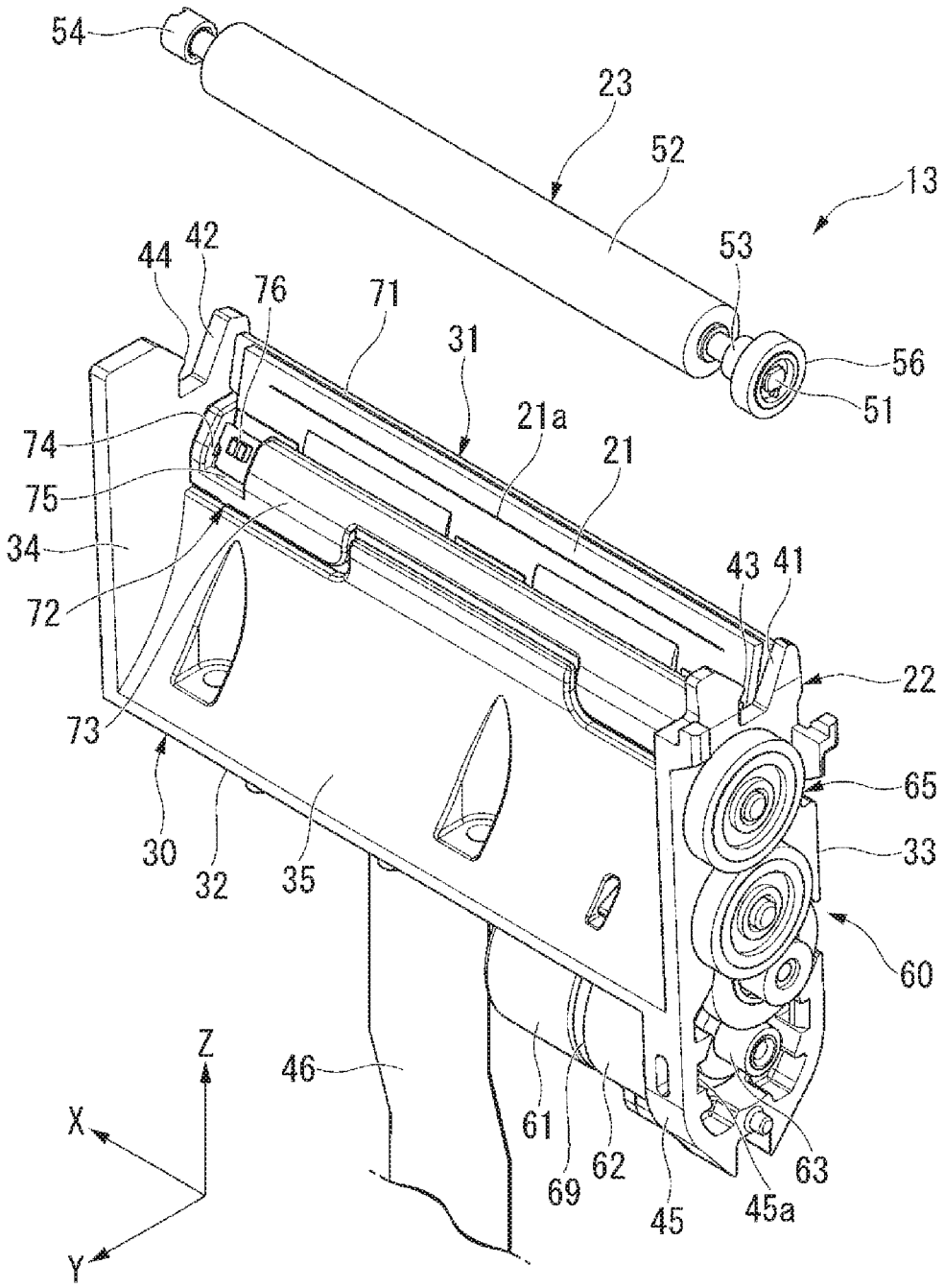
FIG. 3 is an exploded perspective view of the thermal printer according to the embodiment.

FIG. 2 is a perspective view of the thermal printer 13 according to the embodiment. FIG. 3 is an exploded perspective view of the thermal printer 13 according to the embodiment. As illustrated in FIG. 2, the thermal printer 13 includes a head unit 22 and a platen roller 23. The head unit 22 includes a thermal head 21.

In the example illustrated in FIG. 1, the head unit 22 is assembled to the casing main body 15. The platen roller 23 is assembled to the printer cover 16. The platen roller 23 is rotatably supported by the printer cover 16. The printer cover 16 has a support shaft in a lower portion of FIG. 1, and is opened toward a left front side of FIG. 1. At that time, the platen roller 23 moves to follow the printer cover 16. With this action, connection between the platen roller 23 and the head unit 22 is released so that the recording paper P is brought into a free state. Conversely, when the printer cover 16 is closed, the platen roller 23 also moves to follow the printer cover 16. At this time, the platen roller 23 returns to a position in contact with the thermal head 21. As described above, the head unit 22 and the platen roller 23 are combined so as to be separable along with opening and closing of the printer cover 16. When the printer cover 16 takes a closed position, the head unit 22 and the platen roller 23 are opposed to each other across the discharge port 18.

As described above, the thermal printer 13 has a configuration in which the platen roller 23 and the head unit 22 are removable. Therefore, a gap (not shown) is formed in a joint (boundary portion between the casing main body 15 and the printer cover 16) of an exterior (casing 11).

The following description is given through use of an XYZ orthogonal coordinate system as required. In the following description, an axial direction of the platen roller 23 is referred to as "X direction" (first direction), and two directions orthogonal to the X direction are referred to as "Y direction" (second direction) and "Z direction" (third direction). Further, in each of the X direction, the Y direction, and the Z direction, a direction indicated by the arrow in the drawings is described as a plus direction, and a direction opposite to the arrow is described as a minus direction.

As illustrated in FIG. 3, the head unit 22 includes a frame 30 and a head block 31 supported on the frame 30. The frame 30 includes a base portion 32, a first side plate portion 33, and a second side plate portion 34. The base portion 32 extends in the X direction. The first side plate portion 33 and the second side plate portion 34 are connected to both end portions of the base portion 32 in the X direction.

Figure 4:
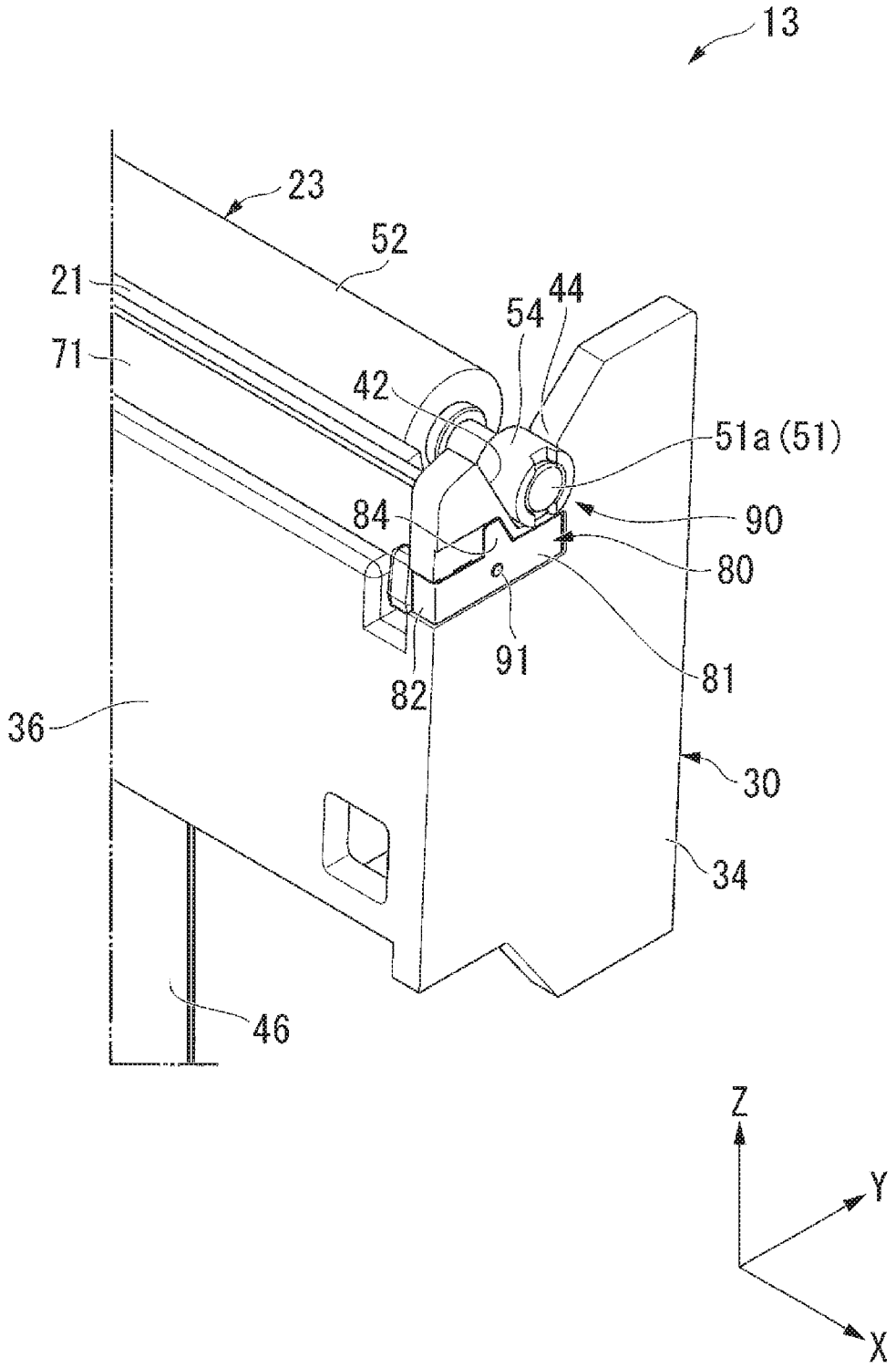
FIG. 4 is a perspective view of a mounting state of a conductive member of the embodiment.

The base portion 32 includes a guide wall 35 and a back surface plate 36 (see FIG. 4). The guide wall 35 is located in a plus Y direction of the base portion 32. The back surface plate 36 is located in a minus Y direction with respect to the guide wall 35. A surface of the guide wall 35 which is oriented in the plus Y direction constructs a paper passage surface which is configured to guide the recording paper P in the plus Z direction. The paper passage surface is a curved surface which protrudes in the minus Y direction.

The first side plate portion 33 is connected to an end portion of the base portion 32, which includes the guide wall 35 and the back surface plate 36, in a minus X direction. At a portion of the first side plate portion 33 which protrudes in the plus Z direction with respect to the base portion 32, a first roller receiving groove 41 is formed. The first roller receiving groove 41 is formed so as to recess in the minus Z direction from an end edge of the first side plate portion 33 in the plus Z direction. At a portion of an inner peripheral edge of the first roller receiving groove 41 which is located in the plus Y direction, there is formed a first hook portion 43 which protrudes in the minus Y direction. A portion of the first side plate portion 33 which protrudes in the minus Z direction with respect to the base portion 32 constructs a motor support portion 45.

The second side plate portion 34 is connected to the end portion of the base portion 32 in a plus X direction. At a portion of the second side plate portion 34, which protrudes in the plus Z direction with respect to the base portion 32, there is formed a second roller receiving groove 42. The second roller receiving groove 42 is formed so as to recess in the minus Z direction from an end edge of the second side plate portion 34 in the plus Z direction. At a portion of an inner peripheral edge of the second roller receiving groove 42 which is located in the plus Y direction, there is formed a second hook portion 44 which protrudes in the minus Y direction.

The platen roller 23 nips the recording paper P with the thermal head 21 to convey the recording paper P toward the discharge port 18 (see FIG. 1). The platen roller 23 includes a platen shaft 51 and a roller main body 52.

The platen shaft 51 extends in the X direction. At both end portions of the platen shaft 51 in the X direction, there are mounted a first bearing 53 and a second bearing 54, respectively. The bearings 53 and 54 are retained in the above-mentioned roller receiving grooves 41 and 42, respectively. With this, the platen roller 23 is supported on the frame 30 so as to be rotatable about an axis extending in the X direction and so as to be removable from the frame 30.

At a portion of the platen shaft 51 which is located in the minus X direction with respect to the first platen shaft 53, there is arranged a driven gear (transmission portion) 56. Under a state in which the platen roller 23 is retained in the roller receiving grooves 41 and 42, the driven gear 56 is positioned in the minus X direction from the first side plate portion 33.

The roller main body 52 is made of, for example, rubber. The roller main body 52 is mounted on the platen shaft 51. The roller main body 52 is provided at a portion of the platen shaft 51 other than the both end portions of the platen shaft 51 in the X direction. An outer peripheral surface of the roller main body 52 is held in contact with the thermal head 21.

At a portion of the above-mentioned frame 30 which is located in the plus X direction with respect to the motor support portion 45, there is arranged a motor (drive source) 61. The motor 61 is arranged under a state in which a rotary shaft (not shown) thereof protrudes in the minus X direction. The motor 61 is connected to the controller through intermediation of a flexible board 46 or the like. The motor 61 is fixed to the frame 30. The motor 61 is exposed to outside.

As illustrated in FIG. 3, the thermal printer 13 includes a power transmission mechanism 60 configured to transmit power of the motor 61 to the platen roller 23. The power transmission mechanism 60 includes a first speed reduction mechanism 62 and a second speed reduction mechanism 65. The first speed reduction mechanism 62 is configured to reduce power of the motor 61. The second speed reduction mechanism 65 is located between the first speed reduction mechanism 62 and the platen roller 23.

The first speed reduction mechanism 62 is arranged between the motor 61 and the motor support portion 45 in the X direction. For example, the first speed reduction mechanism 62 is a planetary gear mechanism. The first speed reduction mechanism 62 has an output gear 63 which protrudes in the minus X direction. The output gear 63 protrudes through a through hole 45*a*, which is formed in the motor support portion 45, in the minus X direction with respect to the motor support portion 45.

The second speed reduction mechanism 65 is arranged in the minus X direction with respect to the first side plate portion 33. For example, the second speed reduction mechanism 65 is a gear train mechanism including a two-step gear. The second speed reduction mechanism 65 provides connection between the output gear 63 of the first speed reduction mechanism 62 and a driven gear 56 of the platen roller 23. The second speed reduction mechanism 65 is covered with a gear cover 66 from the minus X direction (see FIG. 2).

An earth member 69 is configured to connect the motor 61 and a head support plate 71 to each other. For example, the earth member 69 is formed of a member having conductivity such as metal.

As illustrated in FIG. 3, the head block 31 includes the head support plate 71, the thermal head 21, and a sensor holder 72. The head support plate 71 has a plate-like shape extending in the X direction and having a thickness direction in the Y direction. The head support plate 71 is formed of a member having conductivity. For example, the head support plate 71 is made of metal.

The thermal head 21 is affixed to the head support plate 71 from the plus Y direction. The thermal head 21 has a plate-like shape extending in the X direction. On a surface (hereinafter referred to as "head surface") of the thermal head 21, which is oriented in the plus Y direction, a plurality of heating elements 21*a* are arrayed in the X direction at intervals.

The thermal head 21 is connected to, for example, a controller (not shown) through the flexible board 46. In the thermal head 21, heat generation of the heating elements 21*a* is controlled by a driver IC (not shown) mounted to the thermal head 21 in accordance with a signal transmitted from the controller. When the recording paper P passes through the heating elements 21*a*, printing on the recording paper P is performed.

The sensor holder 72 is assembled to the head support plate 71 from the plus Y direction. The sensor holder 72 includes a cover portion 73 located in the plus Z direction with respect to the guide wall 35. A surface of the cover portion 73 which is oriented in the plus Y direction forms a guide surface configured to guide the recording paper P to the thermal head 21. The guide surface is configured to smoothly connect a paper passage surface of the guide wall 35 and the head surface of the thermal head 21 to each other.

At an end portion of the cover portion 73 in the plus X direction, there is formed a passing hole 74 which penetrates through the cover portion 73. At a portion of an opening edge of the passing hole 74, which is located in the minus Z direction, there is formed a seat portion 75 which protrudes in the minus Y direction. A recording paper sensor 76 is supported on the seat portion 75.

For example, the recording paper sensor 76 is a PI sensor (photo sensor) of a reflection type. The recording paper sensor 76 includes a light emitter and a light receiver. Light emitted from the light emitter is reflected on the recording paper P, and the reflected light can be detected by the light receiver. The recording paper sensor 76 is connected to the controller through the flexible board 46. When the reflected light is detected by the light receiver of the recording paper sensor 76, the controller determines that the recording paper P is present within a detection range of the recording paper sensor 76.

Figure 5:
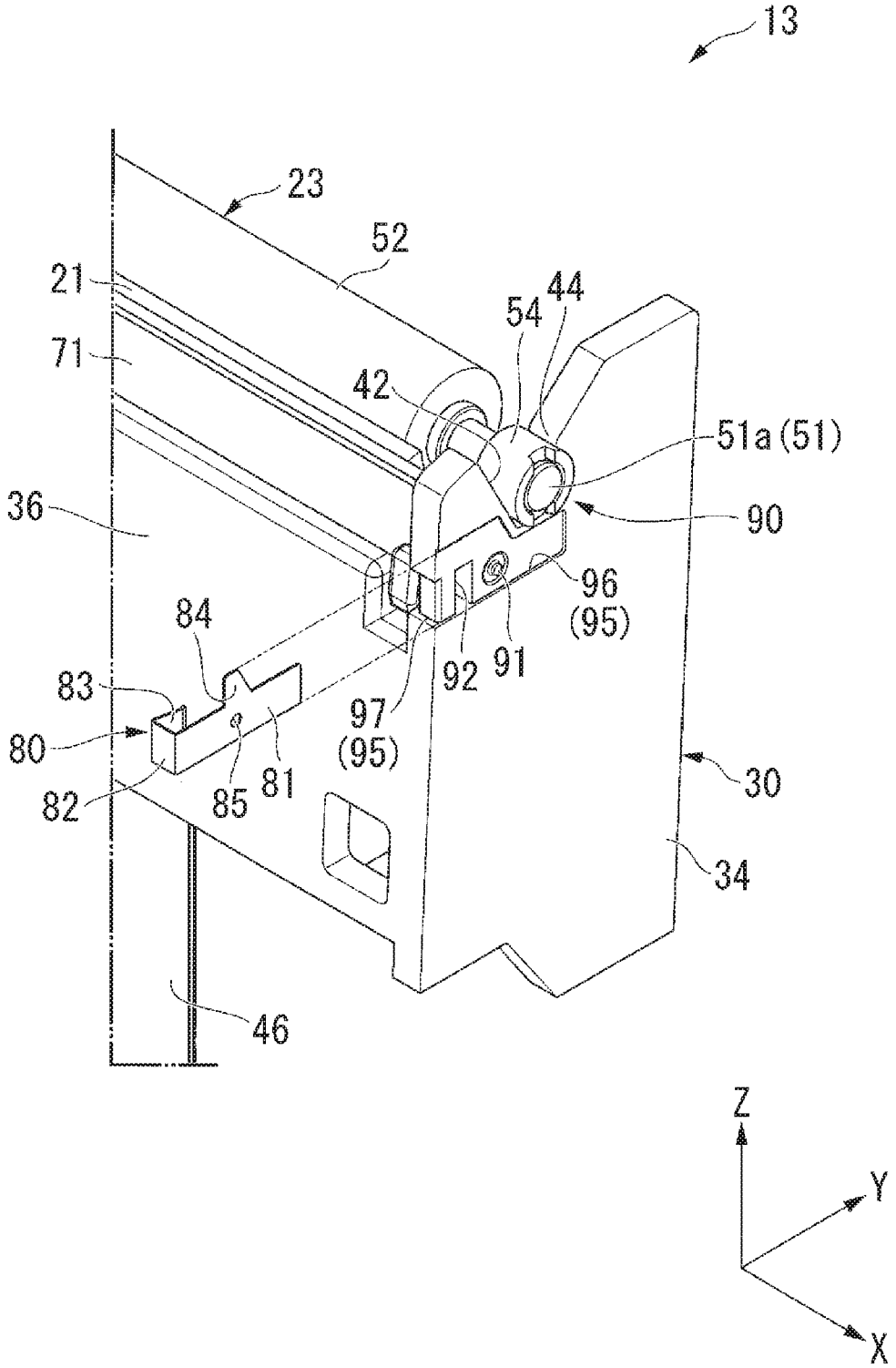
FIG. 5 is a perspective view of a separation state of the conductive member of the embodiment.

FIG. 4 is a perspective view of a mounting state of a conductive member 80 of the embodiment. FIG. 5 is a perspective view of a separation state of the conductive member 80 of the embodiment. As illustrated in FIG. 4, the thermal printer 13 includes the conductive member 80 having conductivity. For example, the conductive member 80 is made of metal. The conductive member 80 is provided between a side surface of a shaft support portion 90 and the head support plate 71. The shaft support portion 90 is a portion which forms the second roller receiving groove 42 in the second side plate portion 34.

Figure 7:
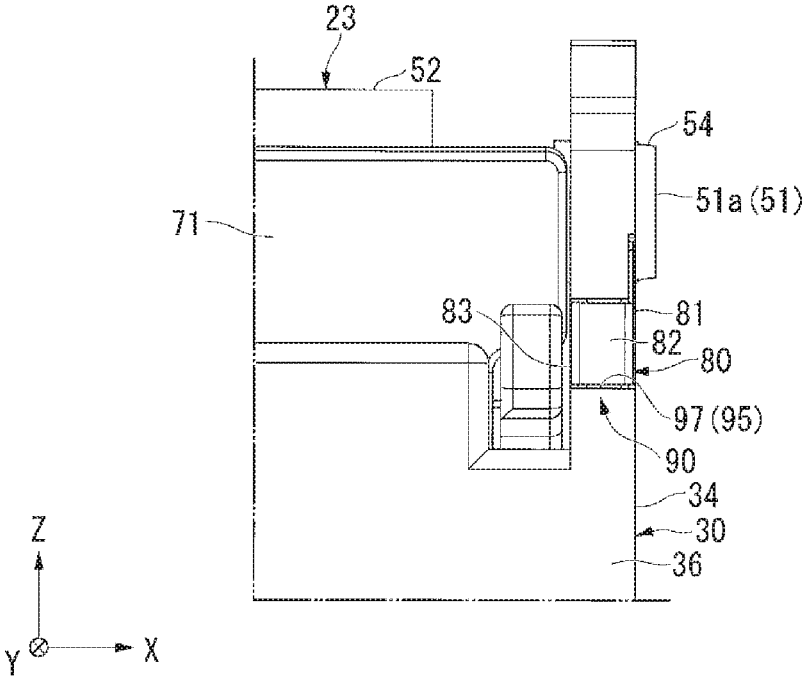
FIG. 7 is a view of the mounting state of the conductive member of the embodiment as seen from a minus Y direction.
Figure 8:
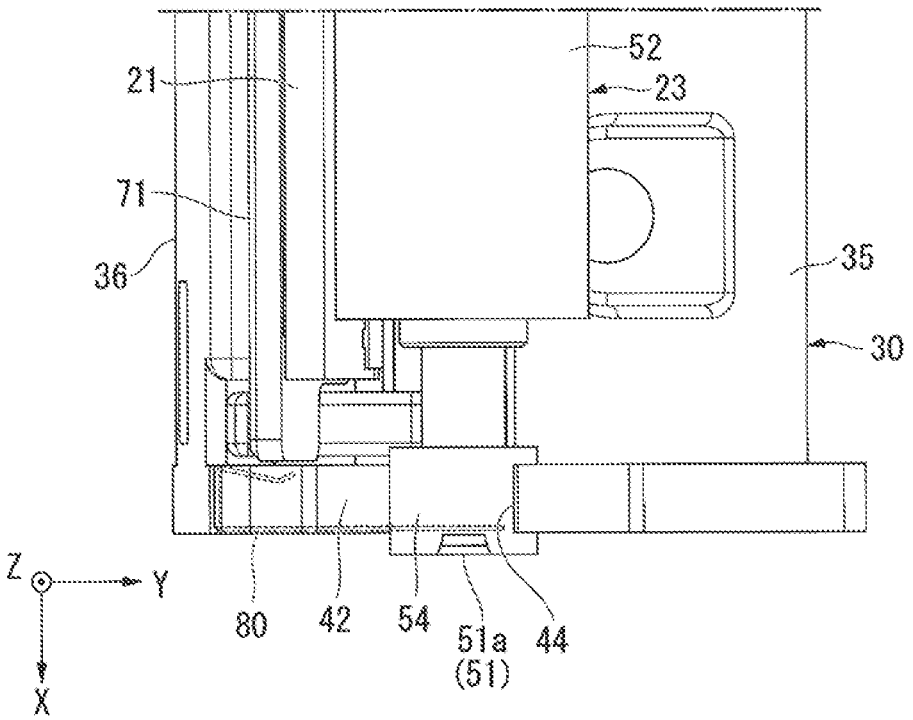
FIG. 8 is a view of the mounting state of the conductive member of the embodiment as seen from a plus Z direction.

The conductive member 80 is provided so as to discharge an electric current in non-contact with the head support plate 71. The conductive member 80 is removably provided to the shaft support portion 90 (see FIG. 5). The conductive member 80 is arranged on an inner side of a shaft end 51*a* of the platen roller 23 in the axial direction (see FIG. 7). The conductive member 80 is located on an inner side of a side surface of the frame 30 in the plus X direction (see FIG. 8).

As illustrated in FIG. 5, the conductive member 80 has a U-shaped clip form opened in the plus Y direction. The conductive member 80 is configured to hold the shaft support portion 90 from an outer side in the X direction (see FIG. 9). The conductive member 80 includes a contact portion 81, a connecting portion 82, and an extending portion 83.

The contact portion 81 extends in the Y direction. The contact portion 81 is held in contact with the side surface of the shaft support portion 90 in the plus X direction (see FIG. 4). The contact portion 81 includes a protruding portion 84 that protrudes in the plus Z direction. The contact portion 81 has a circular through hole 85. The through hole 85 has such a size that a projection portion 91 of the shaft support portion 90 can be inserted into the through hole 85.

The connecting portion 82 is configured to connect the contact portion 81 and the extending portion 83 to each other. The connecting portion 82 extends from an end of the contact portion 81 in the minus Y direction toward the minus X direction.

Figure 9:
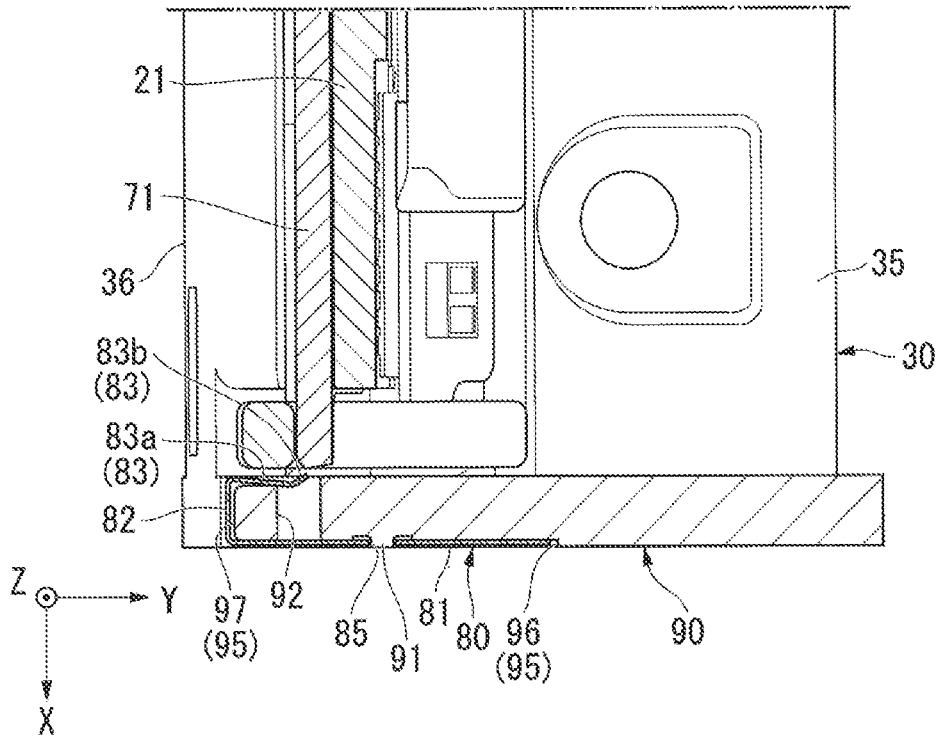
FIG. 9 is a view including an IX-IX cross section of FIG. 6.

The extending portion 83 extends from an end of the connecting portion 82 in the minus X direction toward the plus Y direction (head support plate 71) (see FIG. 9). An engagement hole 92 is formed so as to open the shaft support portion 90 in the X direction. As illustrated in FIG. 9, the extending portion 83 includes a first inclined portion 83*a* and a second inclined portion 83*b*. The first inclined portion 83*a* is inclined from the end of the connecting portion 82 in the minus X direction toward the engagement hole 92. The second inclined portion 83*b* is inclined from an end of the first inclined portion 83*a* in the plus Y direction toward the head support plate 71.

The first inclined portion 83*a* is inclined so that the end of the first inclined portion 83*a* in the plus Y direction is located on the plus X direction side with respect to the position of an end of the first inclined portion 83*a* in the minus Y direction. The second inclined portion 83*b* is inclined so that an end of the second inclined portion 83*b* in the plus Y direction is located on the minus X direction side with respect to the position of an end of the second inclined portion 83*b* in the minus Y direction.

For example, the conductive member 80 is formed of a member having a restoring force (for example, a metal plate). The projection portion 91 of the shaft support portion 90 is inserted into the through hole 85 in the contact portion 81. The end of the first inclined portion 83*a* of the extending portion 83 in the plus Y direction (coupled portion between the first inclined portion 83*a* and the second inclined portion 83*b*) is held in the engagement hole 92. With this, the conductive member 80 is removable from the shaft support portion 90.

The end of the second inclined portion 83*b* of the extending portion 83 in the plus Y direction is away from the head support plate 71. With this, the conductive member 80 can discharge an electric current in non-contact with the head support plate 71.

The shaft support portion 90 includes a receiving recess portion 95 configured to receive the conductive member 80. The receiving recess portion 95 includes a first recess portion 96 that is formed more deeply than the thickness (length in the X direction) of the contact portion 81, and a second recess portion 97 that is formed more deeply than the thickness (length in the Y direction) of the connecting portion 82.

The first recess portion 96 is configured to receive the contact portion 81 so that the contact portion 81 is located on an inner side of the side surface of the shaft support portion 90 in the plus X direction. The first recess portion 96 has a contour along an outer shape of the contact portion 81 so as to allow the conductive member 80 to be removed (see FIG. 5).

The second recess portion 97 is configured to receive the connecting portion 82 so that the connecting portion 82 is located on an inner side of the side surface of the shaft support portion 90 in the minus Y direction. The second recess portion 97 has a contour along an outer shape of the connecting portion 82 (see FIG. 5).

Figure 6:
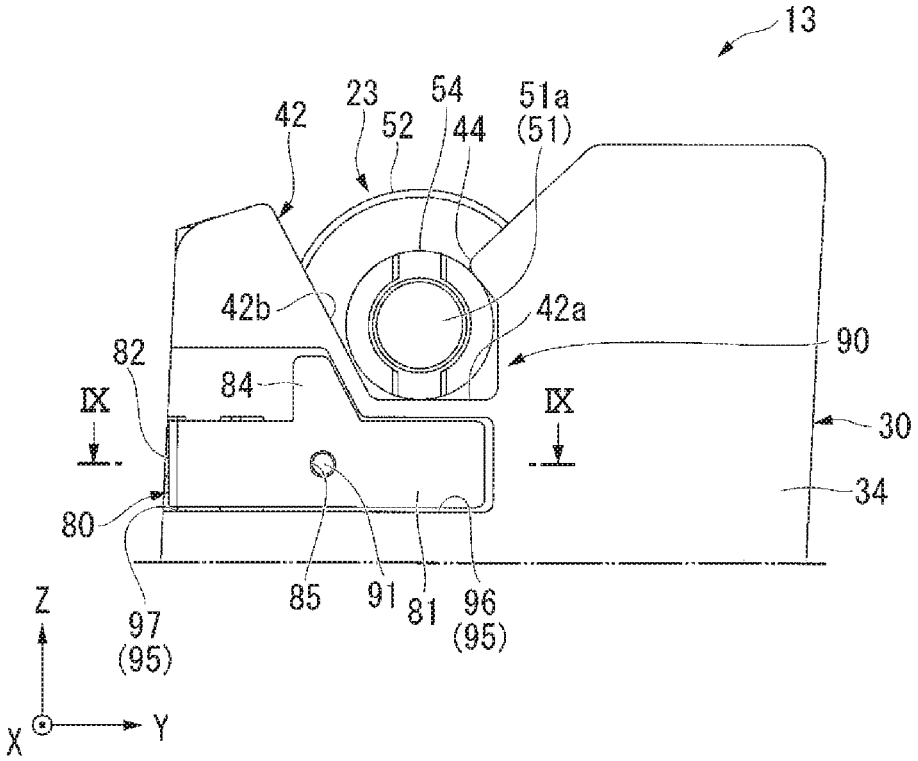
FIG. 6 is a side view of the mounting state of the conductive member of the embodiment (view of the mounting state as seen from a plus X direction).

As illustrated in FIG. 6, the shaft support portion 90 has the second roller receiving groove 42 (hereinafter referred to also as "groove portion 42") having edge portions 42*a* and 42*b* configured to surround the platen roller 23 about the axis. The conductive member 80 is adjacent to at least a part of the edge portions 42*a* and 42*b* of the groove portion 42. The edge portions 42*a* and 42*b* include a first edge 42*a* extending in the Y direction and a second edge 42*b* being continuous to the end of the first edge 42*a* in the minus Y direction. The second edge 42*b* is inclined so that an end of the second edge 42*b* in the minus Y direction is located on the plus Z direction side with respect to the position of an end of the second edge 42*b* in the plus Y direction.

The conductive member 80 is adjacent to each of the first edge 42*a* and the second edge 42*b*. The contact portion 81 (portion in the plus Y direction from the protruding portion 84) of the conductive member 80 has a contour along the first edge 42*a*. The protruding portion 84 (inclined portion) of the conductive member 80 has a contour along the second edge 42*b*.

Next, an operation method of the portable terminal 1 is described. In the following description, it is assumed that a leading edge of the recording paper P is nipped between the platen roller 23 and the thermal head 21. In the portable terminal 1, printing on the recording paper P is started through operation to the input display portion 12. Specifically, a signal is output from the controller to the motor 61 through, for example, the flexible board 46, with the result that the motor 61 rotates. The power of the motor 61 is reduced by the first speed reduction mechanism 62 and the second speed reduction mechanism 65 and thereafter is transmitted to the driven gear 56. With this, the platen roller 23 is rotated. Then, the recording paper P nipped between the outer peripheral surface of the platen roller 23 and the thermal head 21 is delivered toward the discharge port 18.

When the signal is output from the controller to the thermal head 21 through the flexible board 46 during the course of delivering the recording paper P through rotation of the platen roller 23, the heating elements 21*a* of the thermal head 21 generate heat as appropriate. With this, various information is printed on the recording paper P. Then, the recording paper P discharged through the discharge port 18 is cut and used as, for example, a receipt.

Figure 10:
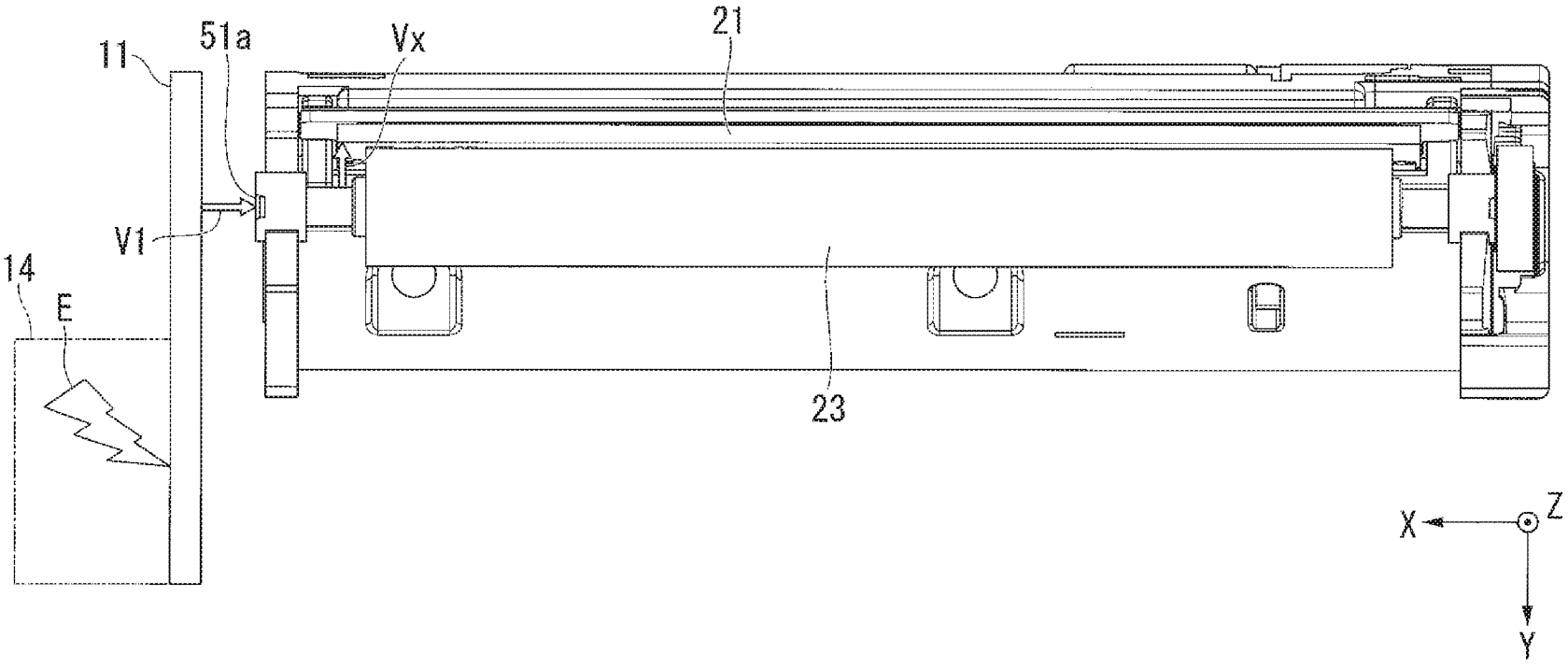
FIG. 10 is an explanatory view of a discharge path in a comparative example.

Next, the action of the conductive member 80 is described together with a comparative example. FIG. 10 is an explanatory view of a discharge path in the comparative example. In the comparative example, the conductive member 80 of the embodiment is not provided. For example, when a card is slid in the slot of the card reader 14, static electricity E is generated due to friction caused when the card is slid. The static electricity E generated outside the casing 11 enters the casing 11 through the gap (not shown) of the casing 11. Then, discharge to the shaft end 51*a* of the platen roller 23 occurs (arrow V1 of FIG. 10). When discharge to the shaft end 51*a* of the platen roller 23 occurs, secondary discharge occurs in the thermal head 21 close to the platen roller 23 (arrow Vx of FIG. 10). When discharge occurs in the thermal head 21, there is a risk in that the electricity thereof may be routed to the control board of the terminal through the flexible substrate 46 (see FIG. 2), resulting in an electrical malfunction.

Figure 11:
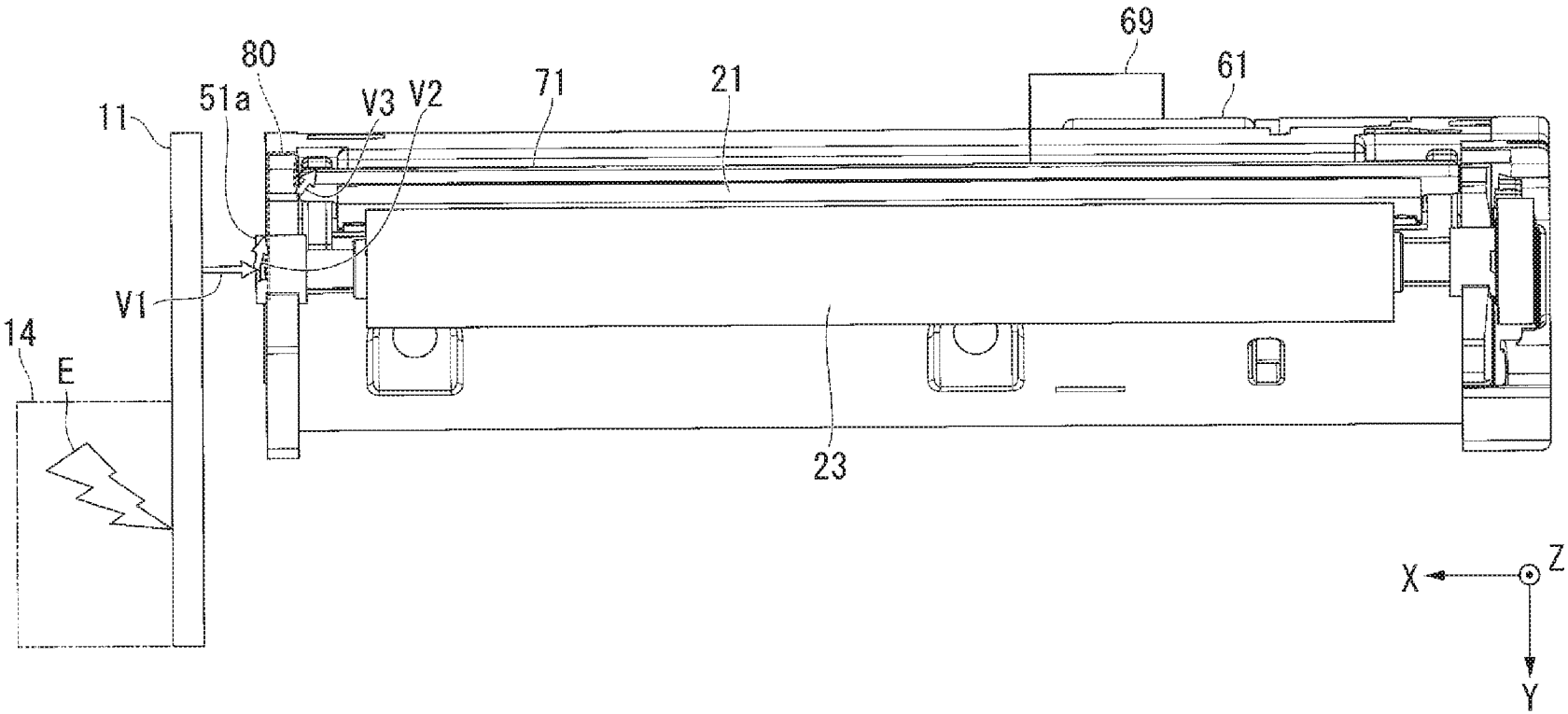
FIG. 11 is an explanatory view of a discharge path of the embodiment.

FIG. 11 is an explanatory view of a discharge path of the embodiment. For example, when a card is slid in the slot of the card reader 14, static electricity E is generated due to friction caused when the card is slid. The static electricity E generated outside the casing 11 enters the casing 11 through the gap (not shown) of the casing 11. Then, discharge to the shaft end 51*a* of the platen roller 23 occurs (arrow V1 of FIG. 11). When discharge to the shaft end 51*a* of the platen roller 23 occurs, secondary discharge occurs in the conductive member 80 close to the platen roller 23 (arrow V2 of FIG. 11). When discharge occurs in the conductive member 80, tertiary discharge occurs in the head support plate 71 close to the conductive member 80 (arrow V3 of FIG. 11). The electricity transmitted to the head support plate 71 is routed to the motor 61 through the earth member 69, and is earth-connected to a housing (frame ground) of the motor 61.

In the embodiment, a path in which the static electricity E generated outside does not pass through the thermal head 21 is secured. Therefore, there is a low risk in that the static electricity E generated outside may be routed to the control board of the terminal through the flexible substrate 46 (see FIG. 2), resulting in an electrical malfunction.

As described above, the thermal printer 13 according to the embodiment includes the thermal head 21 configured to perform printing on recording paper; the platen roller 23, which is arranged at a position opposed to the thermal head 21, and is configured to convey the recording paper by nipping the recording paper between the thermal head 21 and the platen roller 23; the head support plate 71 having conductivity, which has the thermal head 21 fixed thereto; the frame 30, which is configured to support the head support plate 71, and includes a shaft support portion 90 configured to rotatably support the platen roller 23 about an axis; and the conductive member 80 having conductivity, which is provided between the side surface of the shaft support portion 90 and the head support plate 71.

According to this embodiment, the conductive member 80 is provided between the side surface of the shaft support portion 90 and the head support plate 71, and hence the static electricity discharged from outside to the shaft support portion 90 of the frame 30 is earth-connected to the frame ground through the conductive member 80 and the head support plate 71. Therefore, a path in which the static electricity discharged from outside does not pass through the thermal head 21 can be secured. As a result, the static electricity discharged from outside can be released to the ground. In addition, only the conductive member 80 (only one additional component) can handle the above-mentioned situation, and hence countermeasures against the static electricity can be taken at low cost.

Further, in this embodiment, the conductive member 80 is provided so as to discharge an electric current in non-contact with the head support plate 71.

According to this embodiment, the conductive member 80 is away from the head support plate 71, and hence the influence of the movement (for example, minute vibration) of the head support plate 71 on the conductive member 80 can be suppressed. In addition, as compared to the case in which a pressure-sensitive adhesive tape for bringing the conductive member 80 into contact with the head support plate 71 is provided, the number of components can be reduced, thereby being capable of achieving reduction in cost.

Further, in this embodiment, the conductive member 80 is removably provided to the shaft support portion 90.

According to this embodiment, it is preferred that the conductive member 80 be removably provided to the shaft support portion 90 because the conductive member 80 can be removed from the shaft support portion 90 in accordance with the specifications of the portable terminal 1. For example, when the portable terminal 1 is a card settlement terminal, the static electricity discharged from outside can be released to the ground by mounting the conductive member 80 on the shaft support portion 90. For example, when the portable terminal 1 is a terminal other than the card settlement terminal (for example, when the card reader is not provided to the side surface of the thermal printer 13), the portable terminal 1 can be reduced in weight by removing the conductive member 80 from the shaft support portion 90.

Further, in this embodiment, the shaft support portion 90 has the groove portion 42 having the edge portions 42*a* and 42*b* that surround the platen roller 23 about the axis, and the conductive member 80 is adjacent to at least a part of the edge portions 42*a* and 42*b* of the groove portion 42.

According to this embodiment, the platen roller 23 and the conductive member 80 can be brought close to each other to the extent possible, and hence the static electricity discharged to the platen roller 23 can be more reliably discharged to the conductive member 80. In addition, in the embodiment, the conductive member 80 is adjacent to each of the first edge 42*a* and the second edge 42*b* of the groove portion 42. With this, the following effect can be attained. As compared to the case in which the conductive member 80 is adjacent to only any one of the first edge 42*a* and the second edge 42*b* of the groove portion 42, the static electricity discharged to the platen roller 23 can be more reliably discharged to the conductive member 80.

Further, in this embodiment, the conductive member 80 is arranged on the inner side of the shaft end 51*a* of the platen roller 23 in an axial direction.

According to this embodiment, as compared to the case in which the conductive member 80 is arranged on an outer side of the shaft end 51*a* of the platen roller 23 in the axial direction, the thermal printer 13 can be downsized in the axial direction.

Further, in this embodiment, the thermal printer 13 further includes the drive source 61, which is fixed to the frame 30, and is exposed to outside; the power transmission mechanism 60 configured to transmit power of the drive source 61 to the platen roller 23; and the earth member 69 configured to connect the drive source 61 and the head support plate 71 to each other.

According to this embodiment, the static electricity discharged from outside to the shaft support portion 90 of the frame 30 is earth-connected to the frame ground through the conductive member 80, the head support plate 71, the earth member 69, and the drive source 61. The drive source 61 is exposed to outside in the thermal printer 13, and hence is easily accessed in the terminal. Through formation of a path in which the static electricity is earth-connected from the drive source 61 that is easily accessed in the terminal to the frame ground, the degree of freedom of layout of the terminal can be improved.

The portable terminal 1 according to this embodiment includes the thermal printer 13 described above; and the casing 11 to which the thermal printer 13 is mounted.

According to this embodiment, the portable terminal 1 capable of releasing the static electricity discharged from outside to the ground can be provided.

Note that, the technical scope of the present invention is not limited to the above-mentioned embodiments, but various modifications may be made without departing from the gist of the present invention.

Figure 12:
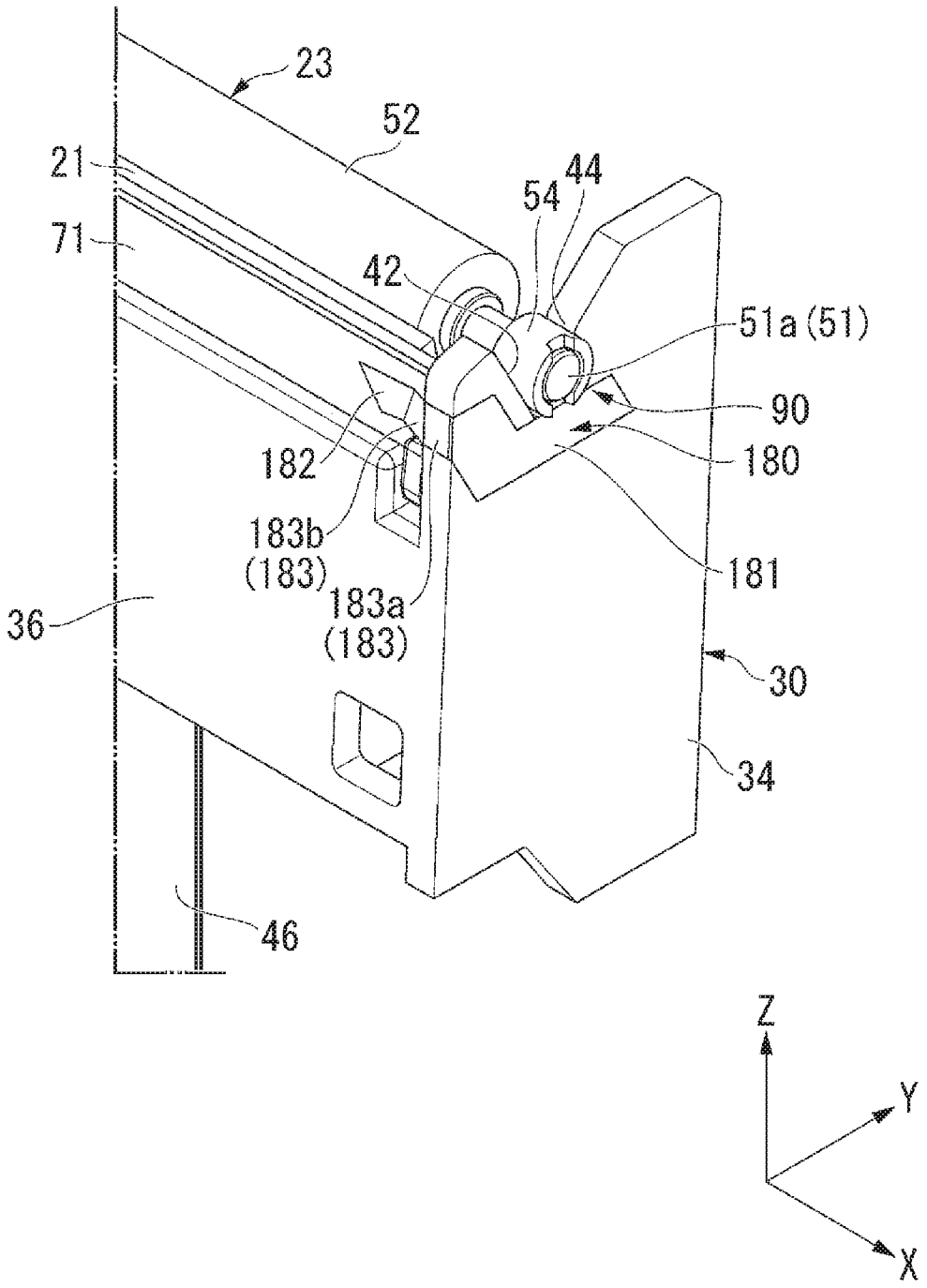
FIG. 12 is a perspective view of a mounting state of a conductive member in a first modification example of the embodiment.

In the above-mentioned embodiment, description is given of the configuration in which the conductive member 80 is provided so as to discharge an electric current in non-contact with the head support plate 71. However, the present invention is not limited thereto. FIG. 12 is a perspective view of a mounting state of a conductive member 180 in a first modification example of the embodiment. For example, as illustrated in FIG. 12, the conductive member 180 may be brought into contact with the head support plate 71. The conductive member 180 may have flexibility. The conductive member 180 may be formed of, for example, a conductive tape having a pressure-sensitive adhesive property.

Figure 15:
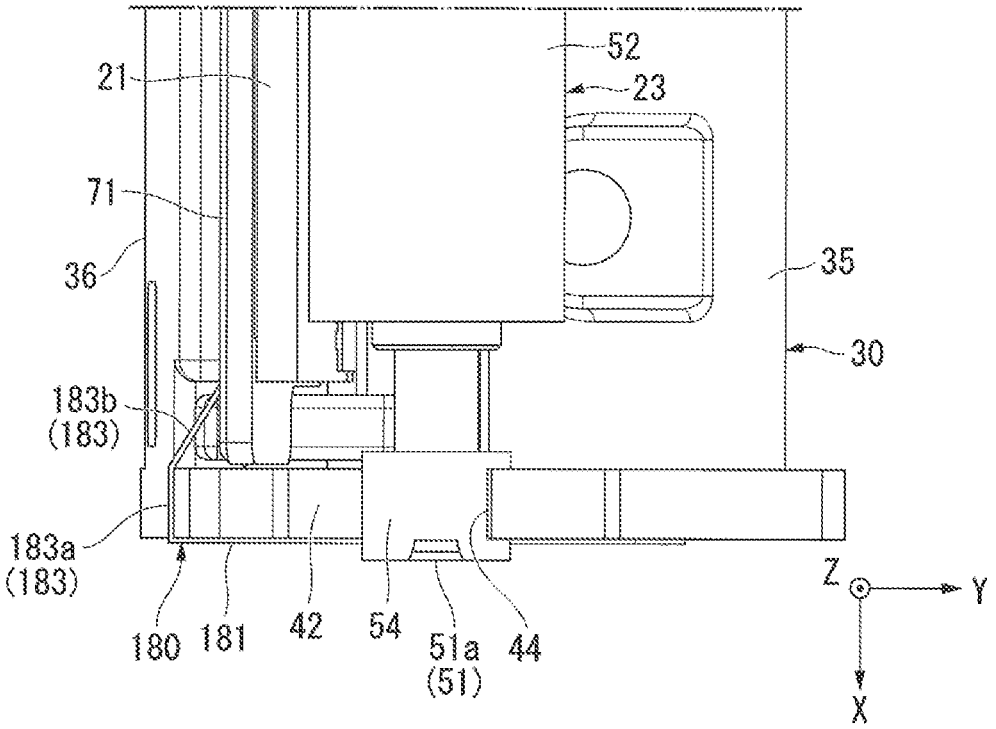
FIG. 15 is a view of the mounting state of the conductive member in the first modification example of the embodiment as seen from the plus Z direction.

The conductive member 180 has a crank shape. The conductive member 180 includes a first contact portion 181, a second contact portion 182, and a connecting portion 183. The first contact portion 181 extends in the Y direction (see FIG. 13). The first contact portion 181 is held in contact with the side surface of the shaft support portion 90 in the plus X direction (see FIG. 15). For example, the first contact portion 181 is affixed to the side surface of the shaft support portion 90 in the plus X direction. The second contact portion 182 is held in contact with the head support plate 71. For example, the second contact portion 182 is affixed to the head support plate 71.

The connecting portion 183 is configured to connect the first contact portion 181 and the second contact portion 182 to each other. At least a part of the connecting portion 183 floats away from each of the shaft support portion 90 and the head support plate 71 (see FIG. 15). The connecting portion 183 includes a connecting contact portion 183*a* and a connecting floating portion 183*b*.

Figure 14:
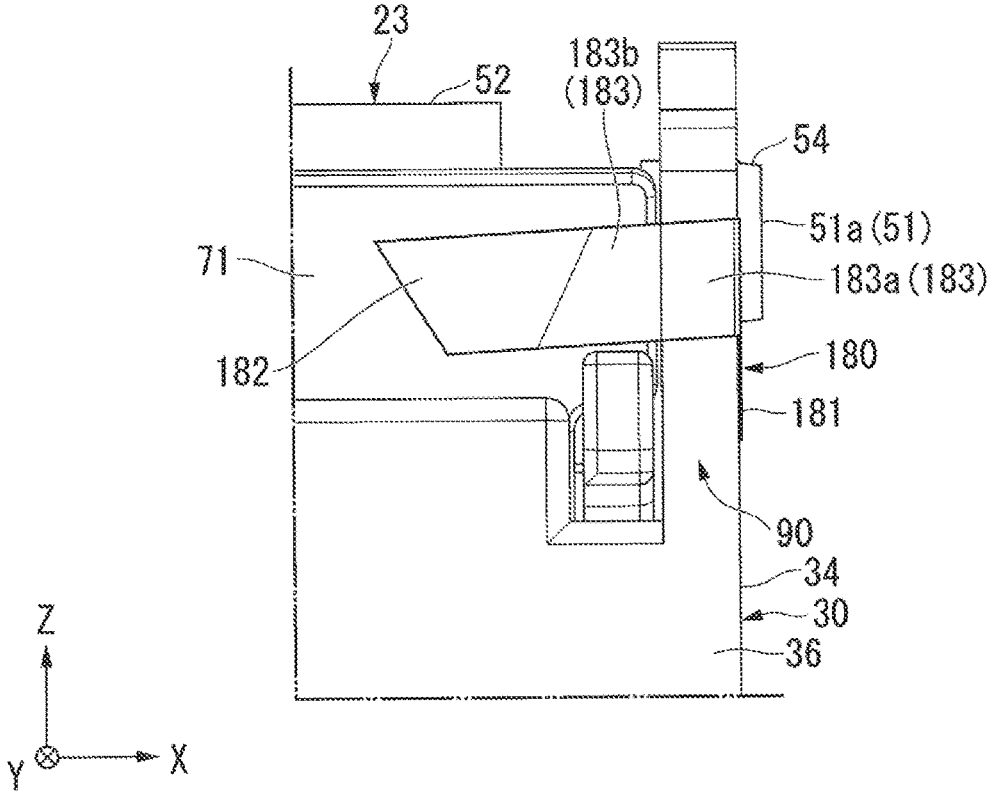
FIG. 14 is a view of the mounting state of the conductive member in the first modification example of the embodiment as seen from the minus Y direction.

The connecting contact portion 183*a* extends from an end of the first contact portion 181 in the minus Y direction toward the minus X direction (see FIG. 14). The connecting contact portion 183*a* is held in contact with an outer surface of the shaft support portion 90 in the minus Y direction (see FIG. 15). For example, the connecting contact portion 183*a* is affixed to the side surface of the shaft support portion 90 in the minus Y direction. The connecting floating portion 183*b* extends from an end of the connecting contact portion 183*a* in the minus X direction toward the head support plate 71. The connecting floating portion 183*b* floats away from each of the shaft support portion 90 and the head support plate 71.

Figure 13:
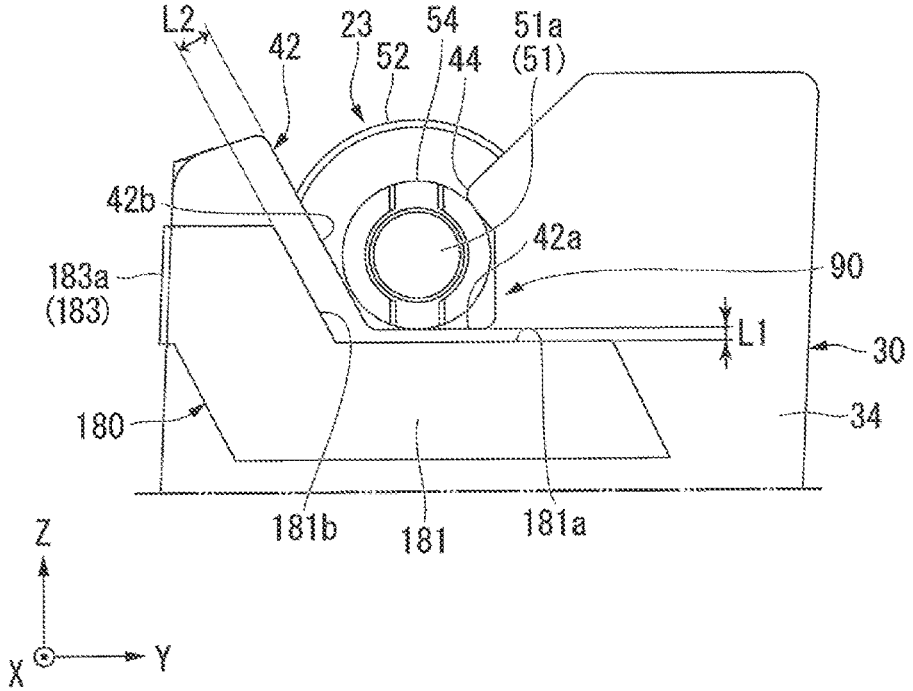
FIG. 13 is a side view of the mounting state of the conductive member in the first modification example of the embodiment (view of the mounting state as seen from the plus X direction).

As illustrated in FIG. 13, the conductive member 180 is adjacent to the first edge 42*a* of the groove portion 42. A gap is formed between the conductive member 180 and the second edge 42*b* of the groove portion 42. The conductive member 180 includes a first side 181*a* that is substantially parallel to the first edge 42*a* and a second side 181*b* that is substantially parallel to the second edge 42*b*. In this case, a distance between the first edge 42*a* and the first side 181*a* is represented by a first distance L1, and a distance between the second edge 42*b* and the second side 181*b* is represented by a second distance L2. The second distance L2 is larger than the first distance L1 (L2>L1).

Figure 16:
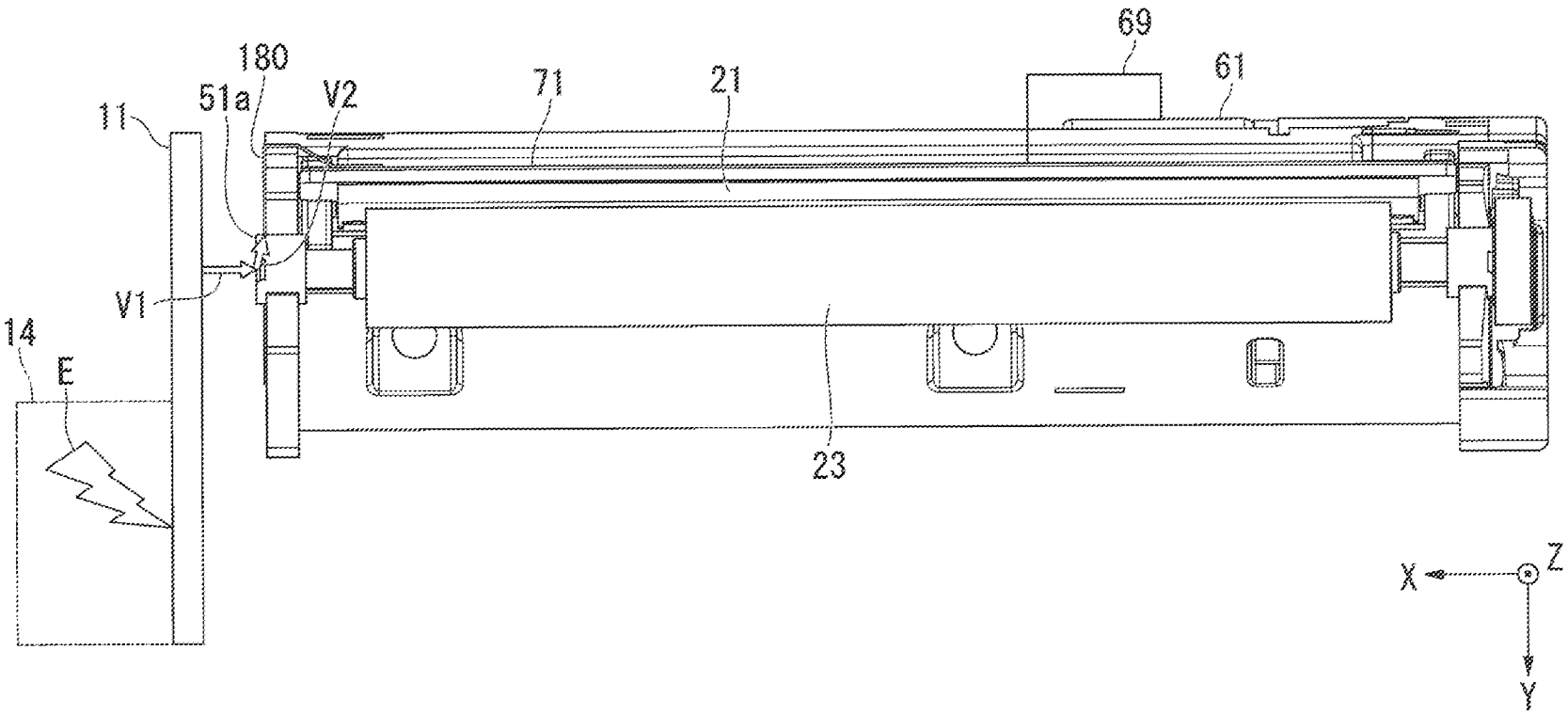
FIG. 16 is an explanatory view of a discharge path in the first modification example of the embodiment.

FIG. 16 is an explanatory view of a discharge path in the first modification example of the embodiment. For example, when a card is slid in the slot of the card reader 14, static electricity E is generated due to friction caused when the card is slid. The static electricity E generated outside the casing 11 enters the casing 11 through the gap (not shown) of the casing 11. Then, discharge to the shaft end 51*a* of the platen roller 23 occurs (arrow V1 of FIG. 16). When discharge to the shaft end 51*a* of the platen roller 23 occurs, secondary discharge occurs in the conductive member 180 close to the platen roller 23 (arrow V2 of FIG. 16). When discharge occurs in the conductive member 180, the electricity thereof is transmitted to the head support plate 71 connected to the conductive member 180. Then, the electricity transmitted to the head support plate 71 is routed to the motor 61 through the earth member 69, and is earth-connected to the housing (frame ground) of the motor 61.

In the first modification example, unlike the embodiment, the discharge path (arrow V3 of FIG. 11) from the conductive member to the head support plate 71 is omitted. In the first modification example, similarly to the embodiment, a path in which the static electricity E generated outside does not pass through the thermal head 21 is secured. Therefore, there is a low risk in that the static electricity E generated outside may be routed to the control board of the terminal through the flexible substrate 46 (see FIG. 2), resulting in an electrical malfunction.

In the first modification example, the conductive member 180 is held in contact with the head support plate 71.

According to the first modification example, as compared to the case in which the conductive member 180 is away from the head support plate 71, the static electricity discharged to the conductive member 180 can be more reliably transmitted to the head support plate 71.

In the first modification example, the conductive member has flexibility.

According to the first modification example, when the conductive member 180 is held in contact with the head support plate 71, the conductive member 180 is capable of following the movement of the head support plate 71. Therefore, as compared to the case in which the conductive member 180 is formed of a rigid body, damages to the conductive member 180 and the like, which are caused by the movement of the head support plate 71, can be suppressed.

In the first modification example, the conductive member 180 includes the first contact portion 181 configured to be brought into contact with the shaft support portion 90; the second contact portion 182 configured to be brought into contact with the head support plate 71; and the connecting portion 183 configured to connect the first contact portion 181 and the second contact portion 182 to each other, and at least a part of the connecting portion 183 floats away from each of the shaft support portion 90 and the head support plate 71.

According to the first modification example, when the conductive member 180 is held in contact with the head support plate 71, the movement of the head support plate 71 can be absorbed by at least a part of the connecting portion 183. Therefore, as compared to the case in which the entire connecting portion 183 is held in contact with each of the shaft support portion 90 and the head support plate 71, damages to the conductive member 180 and the like, which are caused by the movement of the head support plate 71, can be suppressed.

In the first modification example, the conductive member 180 is adjacent to the first edge 42*a* of the groove portion 42. A gap is formed between the conductive member 180 and the second edge 42*b* of the groove portion 42.

In the first modification example, when the conductive member 180 is formed of a conductive tape, the conductive member 180 can be affixed so as to be brought close to the first edge 42*a* of the groove portion 42. Therefore, as compared to the case in which the conductive member 180 is adjacent to each of the first edge 42*a* and the second edge 42*b* of the groove portion 42, the burden in a step of affixing the conductive member 180 can be alleviated.

Figure 17:
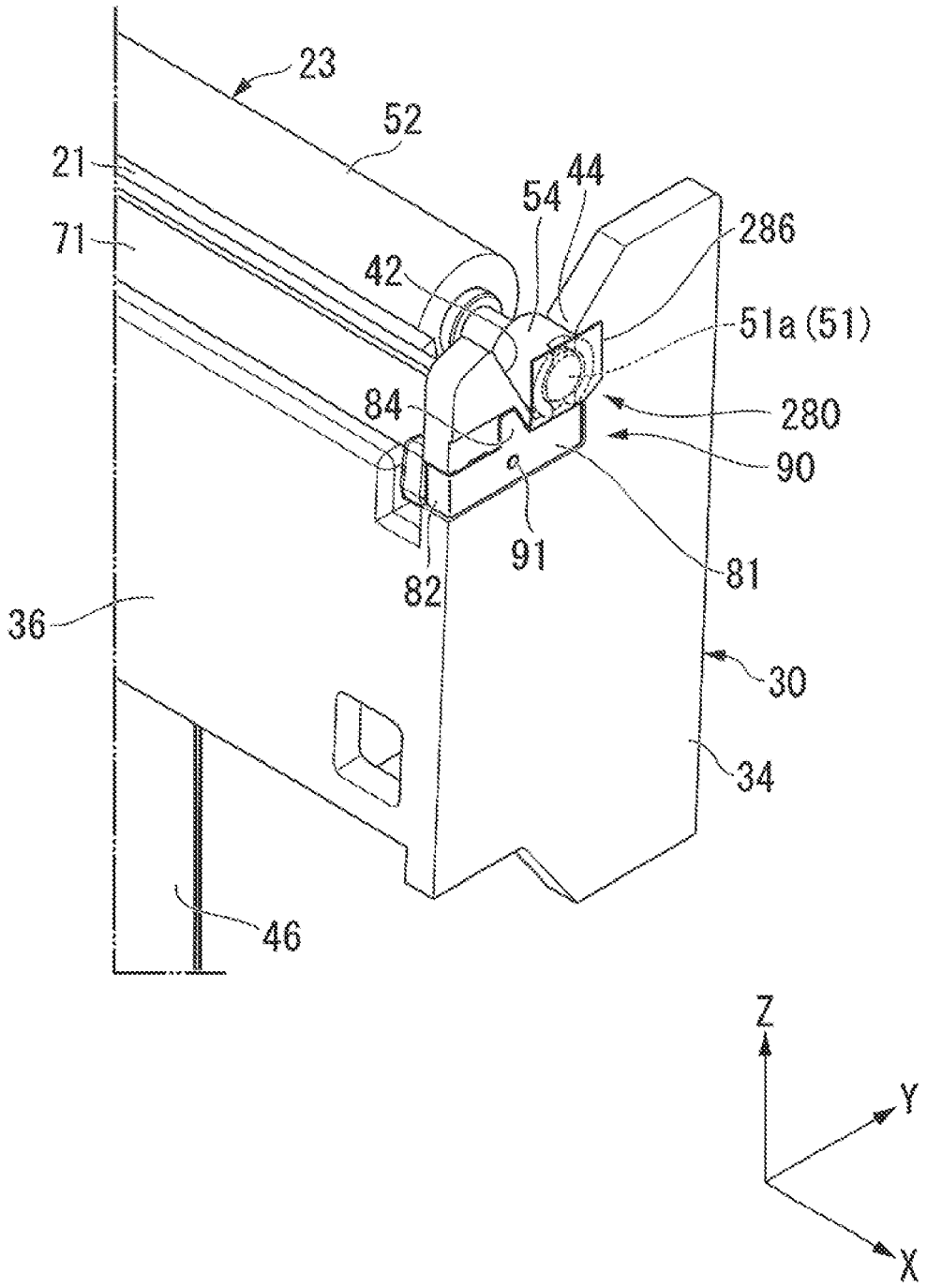
FIG. 17 is a perspective view of a mounting state of a conductive member in a second modification example of the embodiment.

In the above-mentioned embodiment, description is given of the configuration in which the conductive member 80 is arranged on an inner side of the shaft end 51*a* of the platen roller 23 in the axial direction. However, the present invention is not limited thereto. FIG. 17 is a perspective view of a mounting state of a conductive member 280 in a second modification example of the embodiment. For example, as illustrated in FIG. 17, the conductive member 280 may be configured to cover the shaft end 51*a* of the platen roller 23 from an outer side in the axial direction.

The conductive member 280 includes a cover portion 286 configured to cover the shaft end 51*a* of the platen roller 23 from an outer side in the axial direction. The cover portion 286 extends from the contact portion 81 to an outer side of the shaft end 51*a* (plus X direction from the shaft end 51*a*) of the platen roller 23. For example, the cover portion 286 is formed integrally with the contact portion 81 through use of the same member.

In the second modification example, the conductive member 280 is configured to cover the shaft end 51*a* of the platen roller 23 from an outer side in the axial direction.

According to the second modification example, as compared to the case in which the conductive member avoids the shaft end 51*a* of the platen roller 23 when seen from the axial direction, the static electricity discharged from outside can be more reliably discharged to the conductive member 280.

In the above-mentioned embodiment, description is given of the case in which the settlement terminal is used as one example of the portable terminal 1. However, the present invention is not limited thereto. For example, the portable terminal 1 may be applied to various portable terminals other than the settlement terminal.

Besides, the components in the above-mentioned embodiments may be replaced by well-known components as appropriate without departing from the gist of the present invention.

What is claimed is:

1. A thermal printer, comprising:

a thermal head configured to perform printing on recording paper;

a platen roller, which is arranged at a position opposed to the thermal head, and is configured to convey the recording paper by nipping the recording paper between the thermal head and the platen roller;

a head support plate having conductivity, which has the thermal head to be fixed thereto;

a frame, which is configured to support the head support plate, and includes a shaft support portion configured to rotatably support the platen roller about an axis; and a conductive member having conductivity, which is provided between a side surface of the shaft support portion and the head support plate;

wherein the shaft support portion has a groove portion having an edge portion that surrounds the platen roller about the axis, and wherein the conductive member is adjacent to at least a part of the edge portion of the groove portion.

2. The thermal printer according to claim 1, wherein the conductive member is provided so as to discharge an electric current in non-contact with the head support plate.

3. The thermal printer according to claim 1, wherein the conductive member is held in contact with the head support plate.

4. The thermal printer according to claim 3, wherein the conductive member has flexibility.

5. The thermal printer according to claim 4, wherein the conductive member includes:

a first contact portion configured to be brought into contact with the shaft support portion;

a second contact portion configured to be brought into contact with the head support plate; and a connecting portion configured to connect the first contact portion and the second contact portion to each other, and wherein at least a part of the connecting portion is spaced apart from each of the shaft support portion and the head support plate.

6. The thermal printer according to claim 5, wherein the conductive member is arranged on an inner side of a shaft end of the platen roller in an axial direction.

7. The thermal printer according to claim 6, wherein the conductive member is configured to cover the shaft end of the platen roller from an outer side in the axial direction.

8. The thermal printer according to claim 7, further comprising:

a drive source, which is fixed to the frame, and is exposed to outside;

a power transmission mechanism configured to transmit power of the drive source to the platen roller; and an earth member configured to connect the drive source and the head support plate to each other.

9. A portable terminal, comprising:

the thermal printer of claim 8; and a casing to which the thermal printer is mounted.

10. The thermal printer according to claim 1, wherein the conductive member is removably provided to the shaft support portion.

11. The thermal printer according to claim 1, wherein the conductive member is arranged on an inner side of a shaft end of the platen roller in an axial direction.

12. The thermal printer according to claim 1, wherein the conductive member is configured to cover the shaft end of the platen roller from an outer side in the axial direction.

13. The thermal printer according to claim 1, further comprising:

a drive source, which is fixed to the frame, and is exposed to outside;

a power transmission mechanism configured to transmit power of the drive source to the platen roller; and an earth member configured to connect the drive source and the head support plate to each other.

14. A portable terminal, comprising:

the thermal printer of claim 1; and a casing to which the thermal printer is mounted.

15. A thermal printer, comprising:

a thermal head configured to perform printing on recording paper;

a platen roller, which is arranged at a position opposed to the thermal head, and is configured to convey the recording paper by nipping the recording paper between the thermal head and the platen roller;

a head support plate having conductivity, which has the thermal head to be fixed thereto;

a frame, which is configured to support the head support plate, and includes a shaft support portion configured to rotatably support the platen roller about an axis; and a conductive member having conductivity, which is provided between a side surface of the shaft support portion and the head support plate;

wherein the conductive member is configured to cover the shaft end of the platen roller from an outer side in the axial direction.

16. The thermal printer according to claim 15, wherein the conductive member is provided so as to discharge an electric current in non-contact with the head support plate.

17. The thermal printer according to claim 15, wherein the conductive member is held in contact with the head support plate.

18. The thermal printer according to claim 17, wherein the conductive member includes:

a first contact portion configured to be brought into contact with the shaft support portion;

a second contact portion configured to be brought into contact with the head support plate; and a connecting portion configured to connect the first contact portion and the second contact portion to each other, and wherein at least a part of the connecting portion is spaced apart from each of the shaft support portion and the head support plate.

19. The thermal printer according to claim 15, wherein the conductive member is removably provided to the shaft support portion.

20. The thermal printer according to claim 15, wherein the conductive member is arranged on an inner side of a shaft end of the platen roller in an axial direction.

21. The thermal printer according to claim 15, further comprising:

a drive source, which is fixed to the frame, and is exposed to outside;

a power transmission mechanism configured to transmit power of the drive source to the platen roller; and an earth member configured to connect the drive source and the head support plate to each other.

22. A portable terminal, comprising:

the thermal printer of claim 15; and a casing to which the thermal printer is mounted.

* * * * *